US010053765B2

(12) United States Patent
Kim et al.

(10) Patent No.: US 10,053,765 B2
(45) Date of Patent: Aug. 21, 2018

(54) APPARATUS AND METHOD FOR COATING WITH SOLID-STATE POWDER

(71) Applicants: FEMVIX CORP., Yongin-si, Gyeonggi-do (KR); Ok Min Kim, Yongin-si (KR); Ok Ryul Kim, Yongin-si (KR)

(72) Inventors: Ok Min Kim, Yongin-si (KR); Ok Ryul Kim, Yongin-si (KR)

(73) Assignees: FEMVIX CORP., Yongin-si, Gyeonggi-do (KR); Ok Min Kim, Yongin-si, Gyeonggi-do (KR); Ok Ryul Kim, Yongin-si, Gyeonggi-do (KR)

( * ) Notice: Subject to any disclaimer, the term of this patent is extended or adjusted under 35 U.S.C. 154(b) by 265 days.

(21) Appl. No.: 14/903,201

(22) PCT Filed: Jul. 10, 2014

(86) PCT No.: PCT/KR2014/006217
§ 371 (c)(1),
(2) Date: Jan. 6, 2016

(87) PCT Pub. No.: WO2015/005705
PCT Pub. Date: Jan. 15, 2015

(65) Prior Publication Data

US 2016/0153082 A1 Jun. 2, 2016

(30) Foreign Application Priority Data

Jul. 11, 2013 (KR) ..... 10-2013-0081638
Jun. 9, 2014 (KR) ..... 10-2014-0069017

(51) Int. Cl.
*C23C 8/60* (2006.01)
*C23C 24/04* (2006.01)

(52) U.S. Cl.
CPC ..... *C23C 8/60* (2013.01); *C23C 24/04* (2013.01)

(58) Field of Classification Search
CPC ..... C23C 8/60; C23C 24/04
See application file for complete search history.

(56) References Cited

U.S. PATENT DOCUMENTS

| | | | |
|---|---|---|---|
| 6,759,085 | B2 | 7/2004 | Muehlberger |
| 7,153,567 | B1 | 12/2006 | Akedo et al. |
| 2011/0104369 | A1 | 5/2011 | Kim et al. |
| 2013/0192519 | A1 | 8/2013 | Kim et al. |

FOREIGN PATENT DOCUMENTS

| | | | |
|---|---|---|---|
| KR | 10-0203218 | B1 | 6/1999 |
| KR | 10-2008-0110725 | A | 12/2008 |
| KR | 10-0991723 | B1 | 11/2010 |
| KR | 10-2011-0045489 | A | 5/2011 |
| KR | 10-1065271 | B1 | 9/2011 |
| KR | 10-1228004 | B1 | 2/2013 |

*Primary Examiner* — Xiao S Zhao
(74) *Attorney, Agent, or Firm* — Novick, Kim & Lee, PLLC; Sang Ho Lee

(57) ABSTRACT

Provided is an apparatus and a method of spray-coating solid powder on a substrate disposed in a coating chamber which is in a vacuum state, and more particularly, to an apparatus and a method for coating solid powder, which are configured such that a gas sucked from an atmospheric pressure gas, together with a gas supplied from a gas supply unit, can be used as a carrier gas for transporting the solid powder.

21 Claims, 8 Drawing Sheets

APPARATUS AND METHOD FOR COATING WITH SOLID-STATE POWDER

TECHNICAL FIELD

The present invention relates to an apparatus and a method of spray-coating solid powder on a substrate disposed in a coating chamber which is in a vacuum state, and more particularly, to an apparatus and a method for coating solid powder, which are configured such that a gas sucked from an atmospheric pressure gas, together with a gas supplied from a gas supply unit, can be used as a carrier gas for transporting the solid powder.

BACKGROUND ART

Conventional methods of spray-coating solid powder on a substrate in a vacuum state include a vacuum plasma spray (VPS) method, a vacuum cold spray method, an aerosol deposition (AD) method and the like. In the above conventional methods, there is a systemic difficulty in feeding a certain amount of solid powder to a transport pipe smoothly and spraying the solid powder onto a substrate, and for this reason, it is difficult to form a thin or thick coating layer having a uniform thickness, and furthermore, it is difficult to form a uniform coating layer on a substrate having a three-dimensional shape.

In order to form a coating layer having uniform quality by use of a technique of spray-coating solid powder on a substrate in a vacuum state, the solid powder should be able to be fed uniformly to a transport pipe, and this uniform feeding should be able to be continuously maintained.

FIG. 6 is FIG. 1 of U.S. Pat. No. 7,153,567. As shown in FIG. 6, a conventional aerosol deposition (AD) method (U.S. Pat. No. 7,153,567, entitled "Composite structure and method and apparatus for forming the same", hereinafter referred to as "Prior Art 1") employs a method in which a compressed gas is supplied to a chamber containing powder to form aerosol and the aerosol powder is supplied to a transport pipe. In this method, the powder is irregularly scattered by the compressed gas, and thus it is impossible to feed the powder to the transport pipe in a uniform amount.

In an attempt to solve the problem of non-uniform feeding of solid powder, which occurs in Prior Art 1, Korean Patent No. 10-1228004 (PCT/JP2009/054344; EP2264222, entitled "Composite structure forming method, controlled particles, and composite structure forming system"; hereinafter referred to as "Prior Art 2") discloses an improved method in which controlled particles are stored in a storage mechanism, aerosolized, and supplied to a transport pipe.

As shown in FIGS. 21 to 30 attached to the specification of Prior Art 2 (EP2264222)", powder is uniformly fed from the controlled particle-containing storage mechanism and the uniform feeding mechanism, but as shown in FIG. 16 attached to the same specification, the powder is fed to an aerosolization mechanism, like Prior Art 1, and thus the powder reaches a state in which it can be transported in an irregular and non-uniform manner. FIG. 7 is FIG. 16 of EP2264222.

When Prior Art 1 and Prior Art 2 are applied to an apparatus of coating solid powder on a substrate in a vacuum state, the chamber or storage mechanism containing the solid powder will be in a vacuum state during operation of the coating apparatus, and thus the solid powder will be irregularly sucked into the transport pipe. For this reason, it will be difficult to feed a uniform amount of powder to the transport pipe.

FIG. 8 is FIG. 1 of U.S. Pat. No. 6,759,085. In the technology disclosed in U.S. Pat. No. 6,759,085 (entitled "Method and apparatus for low pressure cold spraying"; hereinafter referred to as "Prior Art 3") as shown in FIG. 8, a solid powder feeder is maintained in a vacuum state during operation of the coating apparatus. For this reason, it is difficult to feed a uniform amount of powder to the transport pipe, and thus it is difficult to form a coating layer having a uniform thickness on a substrate. Particularly, it is more difficult to control the coating layer to a thickness of several micrometers.

FIG. 9 is Figure of US 2011/0104369. US 2011/0104369 (entitled "Apparatus and method for continuous powder coating", hereinafter referred to as "Prior Art 4") as shown in FIG. 8 is characterized in that powder feeding is achieved in a more uniform and regular manner compared to the powder feeding methods provided in Prior Art 1 to Prior Art 3.

FIG. 10 is FIG. 1 of US 2013/0192519. Korean Patent No. 10-1065271 (PCT/KR2010/006889; US 2013/0192519; entitled "Solid powder coating apparatus"; hereinafter referred to as "Prior Art 5") is characterized in that one side of a transport pipe is opened to atmospheric pressure, and thus powder feeding is achieved in a more uniform and regular manner compared to the powder feeding method provided in Prior Art 4. However, it is required to overcome the problem in that the suction of solid powder during operation of the coating apparatus is irregular. In addition, Prior Art 5 does not employ a method of transporting solid powder by supplying a compressed gas as disclosed in the prior art, but employs a method in which an air suction unit and a solid powder feeding unit communicate with each other and a mixture of sucked air and solid powder is supplied to a transport pipe. Also, Prior Art 5 employs a method of transporting and spraying solid powder by use of a block chamber communicating with the transport pipe. In addition, in Prior Art 5, the flow rate of a carrier gas capable of flowing through the transport pipe is determined according to air suction flow rate, the cross-sectional area of a spray nozzle, the vacuum pressure of a coating chamber, and chocking conditions, and thus the pressure of the transport pipe is determined so that the solid powder is sprayed through the spray nozzle provided in the vacuum chamber. However, in Prior Art 5, there may be a case in which the spray speed of the carrier gas is not controlled only by the flow rate of air sucked. Thus, it is needed to provide a means and a method capable of controlling even spray speed which is difficult to control only by the flow rate of air sucked.

In other words, as described above, it is needed to provide an apparatus and a method for coating solid powder, which are configured such that solid powder is uniformly fed to a transport pipe, and even a very small amount of solid powder is fed continuously in a finely controlled manner, and a carrier gas is sprayed into a coating chamber at subsonic or supersonic speeds depending on the cross-sectional area of a spray nozzle and the internal pressure of the coating chamber, and the speed of the carrier gas is controlled depending on the required spray speed of solid powder, whereby the quality of coating can be maintained uniformly regardless of the kinds of solid powder and substrate, and a uniform coating thickness can be achieved.

DISCLOSURE

Technical Problem

It is an object of the present invention to provide an apparatus and a method for coating solid powder, which are configured such that a uniform amount of solid powder can be smoothly transported with a sucked gas, and at the same time, and the internal pressure of a transport pipe can be controlled depending on any spray speed by use of a gas that is supplied to the transport pipe through a gas supply unit, and thus the spray speed of a carrier gas can be controlled even when the spray speed of the carrier gas is not controlled only by the flow rate of the sucked gas.

Technical Solution

In order to accomplish the above object, the present invention provides a solid powder coating apparatus comprising:

a transport pipe 10 providing a transport channel for solid powder; a gas supply pipe 15 serving as a flow channel for a gas which is supplied from a gas supply unit 20; a spray nozzle 30 connected to the end of the transport pipe 10 or the gas supply pipe 20; a coating chamber 40 containing the spray nozzle 30; a solid powder feeding unit (not shown) configured to feed the solid powder 4, supplied from an environment which is maintained at atmospheric pressure, to the transport pipe 10; and a pressure control unit 50 configured to control the internal pressure of the coating chamber 40, the apparatus being configured such that an atmospheric pressure gas is sucked into the transport pipe 10 by a negative pressure formed in the coating chamber 40 by operation of the pressure control unit 50, so that a sucked gas 1 together with a supplied gas 2 serves as a carrier gas 3 for transporting the solid powder 4, each of the transport pipe 10 and the gas supply pipe 15 being composed of a first section 10*a* or 15*a*, a second section 10*b* or 15*b* and a third section 10*c* or 15*c*, which are sequentially continuous, wherein the first section 10*a* or 15*a*, the second section 10*b* or 15*b* and the third section 10*c* or 15*c* have a diameter corresponding to any one of the following diameter conditions (1) to (3):

condition (1): first section=second section=third section;

condition (2): first section≥third section≥second section; and condition (3): third section≥first section≥second section.

The present invention provides a solid powder coating method employing a solid powder coating apparatus, the apparatus comprising: a transport pipe 10 and a gas supply pipe 15, which are configured to communicate with each other and are each composed of a first section 10*a* or 15*a*, a second section 10*b* or 15*b* and a third section 10*c* or 15*c*, which are sequentially continuous and have a diameter corresponding to any one of the following diameter conditions (1) to (3):

condition (1): first section=second section=third section;

condition (2): first section≥third section≥second section; and condition (3): third section≥first section≥second section; and a coating chamber 40 containing a spray nozzle 30 connected to the end of the transport pipe 10 or the gas supply pipe, the method being characterized in that a carrier gas 3 consisting of a mixture of a gas 1, sucked into the transport pipe 10 by a negative pressure generated in the coating chamber, and a gas 3 supplied from a gas supply unit 20 to the gas supply pipe 15, transports solid powder 4, introduced into the transport pipe 10 from an environment maintained at atmospheric pressure, so that the solid powder 4 is sprayed through the spray nozzle 30 and the sprayed solid powder 4 is coated on a substrate disposed in the coating chamber 40 which is in a vacuum state.

Advantageous Effects

According to present invention, various problems occurring in conventional technologies of spray-coating solid powder on a substrate can be solved.

First, the flow rate of supplied gas, the pressure of the coating chamber, and the pressure and temperature of the transport pipe can be easily controlled, thereby controlling the spray speed of solid powder, which is not controlled only by the flow rate of sucked gas.

Second, the feed of solid powder can be finely controlled to a predetermined amount by introducing solid powder, supplied from an atmospheric pressure environment, into the transport pipe. Thus, a precise and uniform coating thickness, which cannot be achieved in the prior art, can be achieved even on a large-area substrate (for example, 2 m (width)×2 m (length)), and a coating layer having a uniform coating thickness can be formed even on a three-dimensional substrate along the surface thereof (precise coating at a coating thickness deviation of ±500 nm is possible).

Third, because a combination of sucked gas and supplied gas is used as a carrier gas, the spray of the carrier gas through the spray nozzle can be achieved at subsonic or supersonic speeds depending on the cross-sectional area of the spray nozzle.

Fourth, a mixture of two or more kinds of solid powders can be simultaneously fed into the transport pipe, and two or more kinds of solid powders can also be fed precisely in predetermined amounts and spray-coated on a substrate.

BEST MODE

Figure 1:
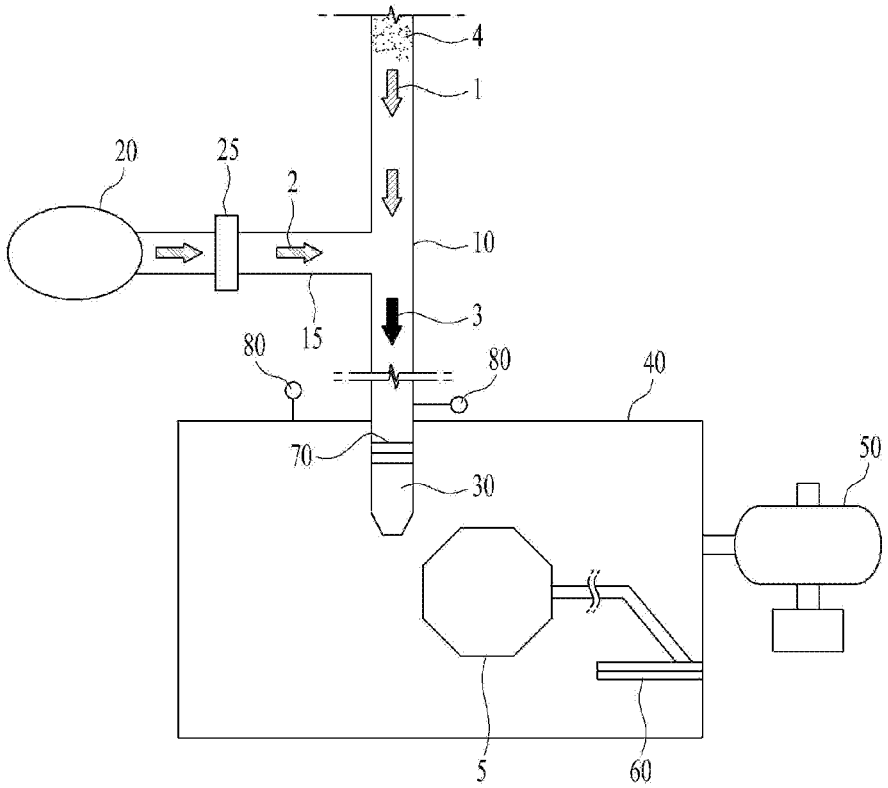
FIG. 1 is a schematic view of an example of a solid powder coating apparatus in which a spray nozzle is connected to the end of a transport pipe.

In the most preferred embodiment, the present invention provides a solid powder coating apparatus comprising:

a transport pipe 10 providing a transport channel for solid powder; a gas feed pipe 15 serving as a flow channel for a gas which is supplied from a gas feeding unit 20; a spray nozzle 30 connected to the end of the transport pipe 10 or the gas feed pipe 20; a coating chamber 40 containing the spray nozzle 30; a solid powder feeding unit (not shown) configured to feed the solid powder 4, supplied from an environment which is maintained at atmospheric pressure, to the transport pipe 10; and a pressure control unit 50 configured to control the internal pressure of the coating chamber 40, the apparatus being configured such that an atmospheric pressure gas is sucked into the transport pipe 10 by a negative pressure formed in the coating chamber 40 by operation of the pressure control unit 50, so that a sucked gas 1 together with a supplied gas 2 serves as a carrier gas 3 for transporting the solid powder 4, each of the transport pipe 10 and the gas feed pipe 15 being composed of a first section 10*a* or 15*a*, a second section 10*b* or 15*b* and a third section 10*c* or 15*c*, which are sequentially continuous, wherein the first section 10*a* or 15*a*, the second section 10*b* or 15*b* and the third section 10*c* or 15*c* have a diameter corresponding to any one of the following diameter conditions (1) to (3):

condition (1): first section=second section=third section;

condition (2): first section≥third section≥second section; and condition (3): third section≥first section≥second section.

MODE FOR INVENTION

Hereinafter, a solid powder coating apparatus and a method according to the present invention will be described in detail with reference to the accompanying drawings.

I. Solid Powder Coating Apparatus

The present invention provides a solid powder coating apparatus comprising:

a transport pipe 10 providing a transport channel for solid powder; a gas feed pipe 15 serving as a flow channel for a gas which is supplied from a gas supply unit 20; a spray nozzle 30 connected to the end of the transport pipe 10 or the gas feed pipe 20; a coating chamber 40 containing the spray nozzle 30; a solid powder feeding unit (not shown) configured to feed the solid powder 4, supplied from an environment which is maintained at atmospheric pressure, to the transport pipe 10; and a pressure control unit 50 configured to control the internal pressure of the coating chamber 40, the apparatus being configured such that an atmospheric pressure gas is sucked into the transport pipe 10 by a negative pressure formed in the coating chamber 40 by operation of the pressure control unit 50, so that a sucked gas 1 together with a supplied gas 2 serves as a carrier gas 3 for transporting the solid powder 4, each of the transport pipe 10 and the gas feed pipe 15 being composed of a first section 10*a* or 15*a*, a second section 10*b* or 15*b* and a third section 10*c* or 15*c*, which are sequentially continuous, wherein the first section 10*a* or 15*a*, the second section 10*b* or 15*b* and the third section 10*c* or 15*c* have a diameter corresponding to any one of the following diameter conditions (1) to (3):

condition (1): first section=second section=third section;

condition (2): first section≥third section≥second section; and condition (3): third section≥first section≥second section.

As used herein, the term "sucked gas 1" refers to a gas sucked from an atmospheric pressure environment into the transport pipe 10 by a negative pressure (lower than atmospheric pressure) applied to one side of the transport pipe 10.

As used herein, the term "supplied gas 2" refers to a gas supplied to the gas supply pipe 15 by the gas supply unit 20.

As used herein, the term "carrier gas 3" refers to a gas mixture of the sucked gas 1 and the supplied gas 2, which transports the solid powder 4.

The spray nozzle 30 is connected to the end of the transport pipe 10 or the gas feed pipe 20.

In the case in which the spray nozzle 30 is connected to the end of the transport pipe 10, the transport pipe 10 serves as a channel through which the sucked gas 1 and the carrier gas 3 move. In this case, as shown in FIG. 1, the solid powder 4 is introduced into the transport pipe 10, and moves with the flow of the sucked gas 1, and then moves toward the spray nozzle 30 at the end of the transport pipe 10 by the flow of the carrier gas 3 containing the gas 2 supplied to the transport pipe 10 from the gas supply pipe 20.

Figure 2:
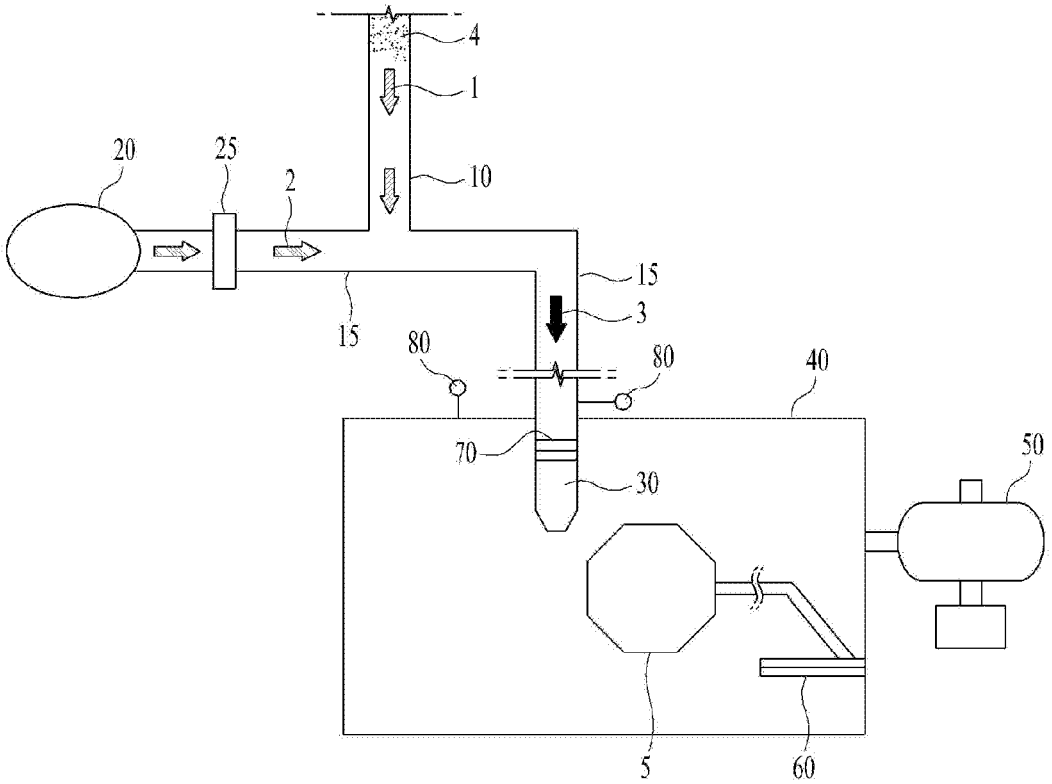
FIG. 2 is a schematic view of an example of a solid powder coating apparatus in which a spray nozzle is connected to the end of a gas feed pipe.

In the case in which the spray nozzle 30 is connected to the end of the gas feed pipe 15, the gas feed pipe 15 serves as a channel through which the supplied gas 2 and the carrier gas 3 move. In this case, as shown in FIG. 2, the solid powder 4 is introduced into the transport pipe 10, and moves with the flow of the sucked gas 1 to the gas feed pipe 15, and is joined with the supplied gas 2 (i.e., moves with the flow of the carrier gas 3), and in this state, it moves toward the injection nozzle 30 at the end of the gas feed pipe 15.

Because the transport pipe 10 and the gas feed pipe communicate with each other, they are influenced by the pressure state of the coating chamber 40 both in the case in which the spray nozzle 30 is connected to the end of the transport pipe 10 or in the case in which the spray nozzle 30 is connected to the end of the gas feed pipe 15. In other words, one side of the transport pipe 10 is opened to atmospheric pressure so that atmospheric pressure gas is sucked into the open side of the transport pipe 10 by a negative pressure formed in the coating chamber 40 by operation of the pressure control unit 50.

The gas feeding unit 20 may be configured to feed any one of oxygen, nitrogen, argon, helium, hydrogen and air to the gas feed pipe 15, and a mixture of two or more of the above-listed gases may be supplied. In addition, the temperature of the supplied gas 2 that is supplied from the gas supply unit 20 to the gas feed pipe 15 may be controlled in the range of 0° C. to 600° C., thereby controlling the spray speed and temperature of the carrier gas 3.

The solid powder coating apparatus according to the present invention may comprise one or more solid powder feeding units (not shown) configured to supply solid powder to the transport pipe 10. The solid powder feeding unit may be configured such that the solid powder 4 in an environment which is maintained at atmospheric pressure is fed and atmospheric pressure gas is sucked by a negative pressure applied to one side of the transport pipe 10 so that the sucked gas together with the solid powder 4 is introduced into the transport pipe 10. The solid powder feeding unit may be provided with a solid powder metering feeder configured to control the amount of solid powder fed per unit time to a constant level.

The spray nozzle 30 connected to the end of the transport pipe 10 or the gas feed pipe 15 is an element configured to spray the solid powder 4 together with the carrier gas 3 into the coating chamber 40 so as to coat the solid powder 4 on the substrate 5.

The spray nozzle 30 is configured to spray the solid powder 4 at critical velocity or higher and less than erosion velocity to thereby maximize coating efficiency. The spray nozzle that is used in the present invention may be a subsonic (Mach No. M<1) nozzle, a sonic (M=1) nozzle or a supersonic (M>1) nozzle depending on the kind and size of solid powder 4. The subsonic nozzle is also known as an orifice nozzle, and has a cross-sectional shape that becomes narrower toward the nozzle outlet. The highest gas spray velocity that can appear at the outlet of the subsonic nozzle cannot exceed Mach No. 1 (M=1). In addition, the supersonic nozzle has a shape whose cross-sectional area becomes smaller as it goes from the nozzle inlet to the nozzle throat and becomes larger as it goes from the nozzle throat to the nozzle outlet. The supersonic nozzle is generally known as a laval nozzle. The supersonic nozzle was developed by Gustaf de Laval (Sweden) in 1897 and used in steam turbines, and since then, the principle thereof was applied to rocket engines by Robert Goddard. The Mach number of the supersonic nozzle is determined according to pressure, temperature, and cross-sectional area ratio. Because critical velocity and erosion velocity vary depending on the kind, size and specific gravity of solid powder 4 to be coated, a spray nozzle suitable for each solid powder 4 can be selectively applied. The spray nozzle 30 that is used in the present invention may be a circular spray nozzle (subsonic nozzle or supersonic nozzle) or a slit nozzle (subsonic nozzle or supersonic nozzle) whose width is greater than its length. When the slit nozzle is used, solid powder can be coated uniformly on a large-area substrate.

To exhibit supersonic or subsonic spray speed, the spray nozzle that is used in the present invention may be either an orifice nozzle having a cross-sectional shape which becomes narrower toward the nozzle outlet, or a laval nozzle having a shape whose cross-sectional area becomes smaller as it goes from the nozzle inlet to the nozzle throat and becomes larger as it goes from the nozzle throat to the nozzle outlet. In other words, according to the intended use, the orifice nozzle may be used to spray the carrier gas at subsonic or sonic speeds, and the laval nozzle may be used to spray the carrier gas at subsonic or supersonic speeds.

A position control unit 70 configured to control relative positions may be coupled to the spray nozzle 30 so as to move the spray nozzle 30 to specific spatial coordinates (x, y and z). The position control unit 70 can be effective in spray-coating a one-, two- or three-dimensional object at any position in a three-dimensional space through the spray nozzle 30. The position control unit 70 may be composed of an arm which is coupled to the spray nozzle 30 so as to be movable linearly, curvilinearly, rotatively or the like.

The coating chamber 40 contains the spray nozzle and provides a space in which the solid powder 4 is coated on a planar substrate or three-dimensional substrate disposed therein.

In the coating chamber 40, a substrate stand 60 may be disposed in a place in which the solid powder 4 is sprayed from the spray nozzle 30, so that its position relative to the spray nozzle 30 can be controlled by controlling the level of the substrate stand 60. In addition, the substrate stand 60 may be coupled with an arm which is movable linearly, curvilinearly, rotatively or the like. In order to eliminate the effect of a reaction force caused by the solid powder 4, a vacuum chuck may be disposed on the substrate stand 60 so that it can adsorb and fix the substrate. When this vacuum chuck is disposed, the shaking of the substrate by the solid powder sprayed can be suppressed.

The coating chamber 40 that is used in the present invention may be configured in various ways so that any kind of substrate can be coated with the solid powder 4. However, for a process of coating solid powder on a substrate made of a hard material such as glass or a metal, a substrate transfer apparatus may be composed of a batch-type apparatus. Herein, the term "batch type" means that a substrate having a certain area is coated while being transported by a transport apparatus. It is to be understood that a substrate made of a soft material such as a polymer film or a foil can be spray-coated while being transferred by the above-described batch-type apparatus, and the substrate transfer device may also be replaced with a roll-to-roll in-line apparatus. An example of this roll-to-roll apparatus may be an apparatus disclosed in Korean Patent No. 0991723, entitled "Roll-to-roll apparatus for continuous deposition of solid powder". The substrate transfer apparatus may be configured such that it can be assembled, disassembled and substituted depending on the material of the substrate. In addition, the substrate transfer apparatus may be configured such that it can control the transfer speed of the substrate, the number of depositions on the substrate, etc.

The coating chamber 40 is preferably made of a material such as stainless steel or an aluminum alloy, which has good durability and can be sufficiently resistant to external pressure even when the inside of the coating chamber is in a vacuum state. In addition, a transparent material may be used as a portion of the material of the coating chamber so that the inside of the coating chamber is visible from the outside. Furthermore, a door may be provided at one side of the coating chamber in order to automatically or manually locate the substrate in the coating chamber or to facilitate operations such as cleaning of the inside of the coating chamber.

The pressure control unit 50 is configured to maintain the inside of the coating chamber 50 at a negative pressure lower than atmospheric pressure. When the internal pressure of the coating chamber 40 is controlled to a negative pressure lower than atmospheric pressure by the pressure control unit 50, atmospheric pressure gas is sucked into the transport pipe 10. This operation is possible because the transport pipe 10 communicates with the coating chamber via the spray nozzle 30.

The pressure control unit 50 may be connected to a vacuum pump configured to maintain the inside of the coating chamber 40 in a vacuum state. The vacuum pump may further comprise a collector capable of collecting solid powder remaining in the coating chamber 40.

In addition, a pressure-temperature measurement unit 80 may be disposed in the transport pipe 10 or the gas feed pipe and in the coating chamber 40 so that temperature and pressure can be checked in real time.

Moreover, the apparatus according to the present invention may comprise a system control unit configured to control the pressure in the front of the spray nozzle 30, the internal pressure of the coating chamber, the flow rate of the gas supplied from the gas feeding unit, and the amount of solid powder fed from the solid powder feeding unit, in a cross-coupled manner, so that operations of the above-described constituent elements can be organically connected.

Figure 4:
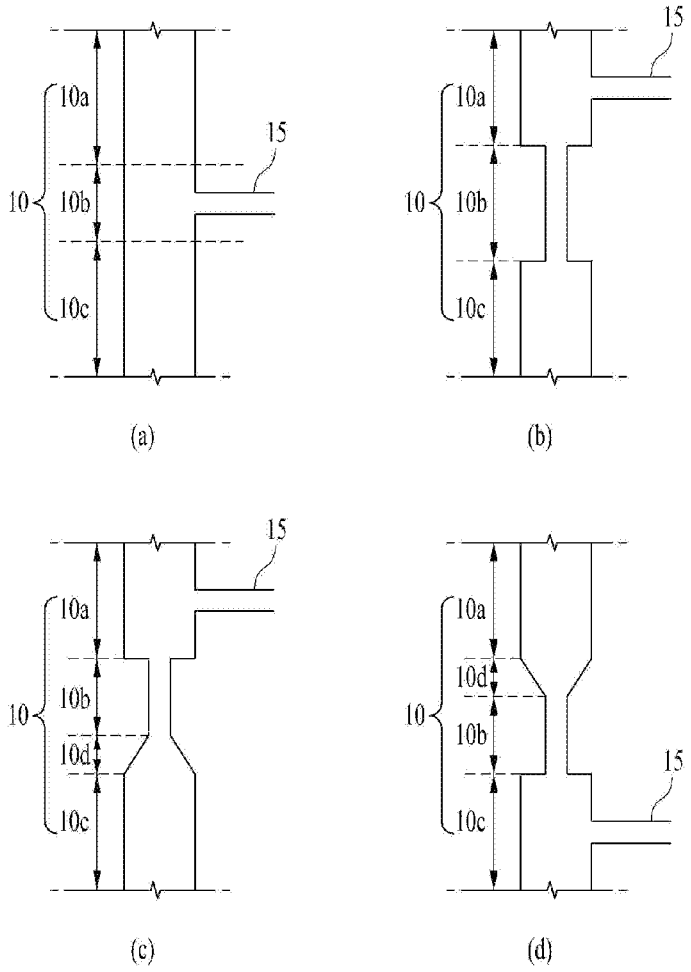
FIG. 4 shows examples in which the diameter of a transport pipe is changed.

Meanwhile, as shown in FIG. 4, the transport pipe 10 may be composed of a first section 10*a*, a second section 10*b* and a third section 10*c*, which are sequentially continuous, wherein the first section 10*a*, the second section 10*b* and the third section 10*c* may have a diameter corresponding to any one of the following diameter conditions (1) to (3):

condition (1): first section=second section=third section;

condition (2): first section≥third section≥third section; and condition (3): third section≥first section≥second section.

Figure 5:
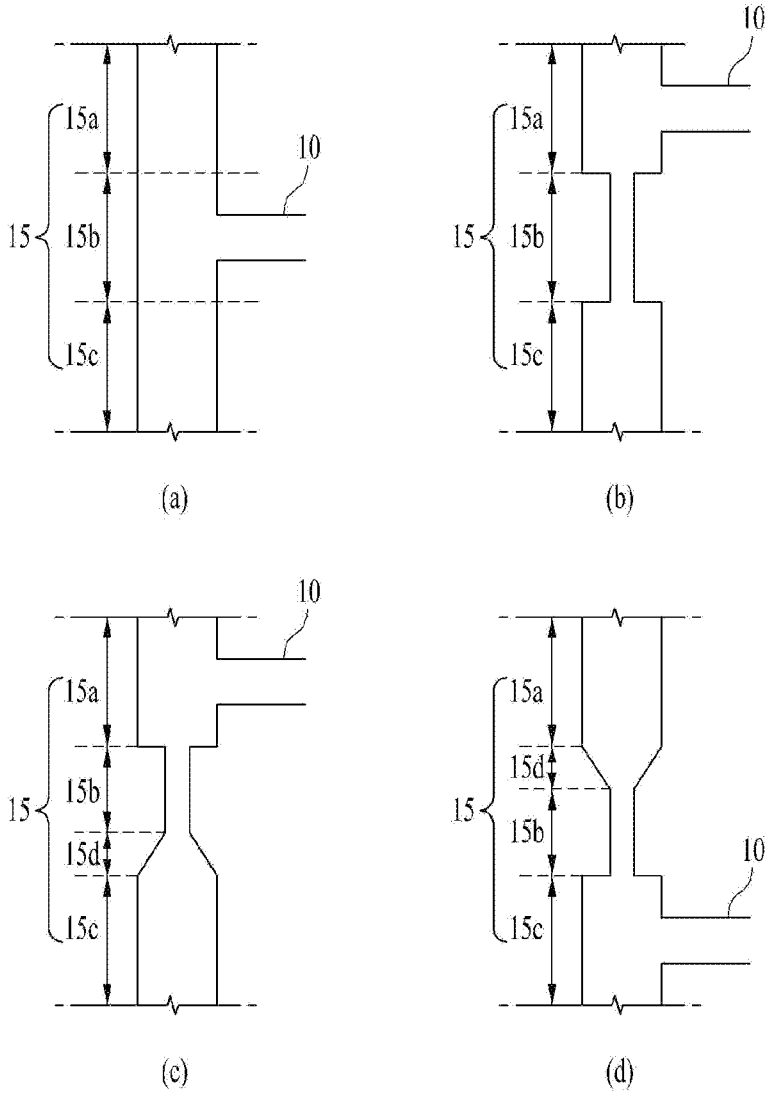
FIG. 5 shows examples in which the diameter of a gas feed pipe is changed.
Figure 6:
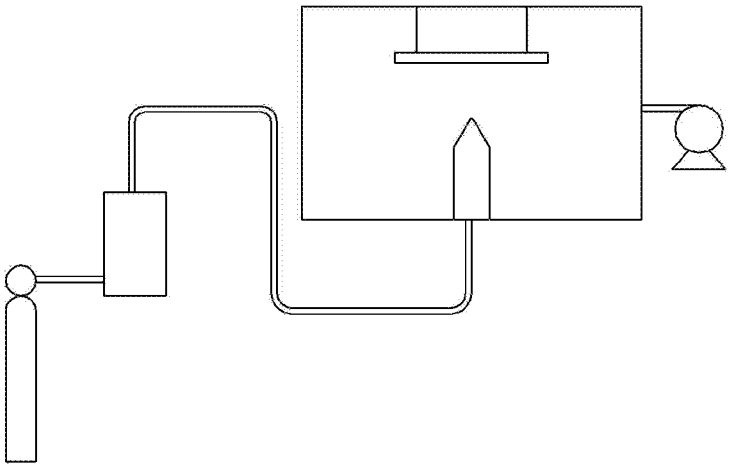
FIG. 6 is FIG. 1 of U.S. Pat. No. 7,153,567 (Prior Art 1), in which no reference numerals are used.
Figure 7:
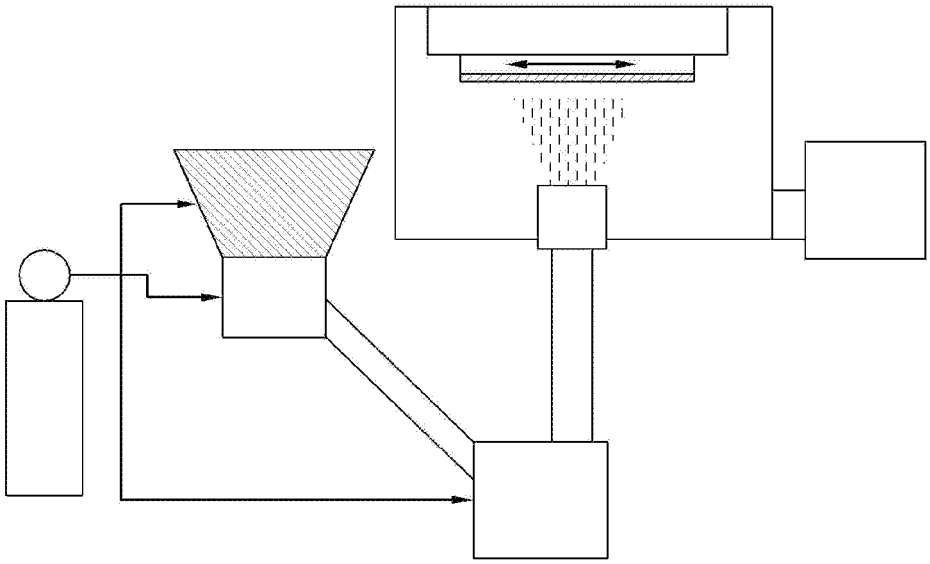
FIG. 7 is FIG. 16 of EP2264222 (Prior Art 2), in which no reference numerals are used.
Figure 8:
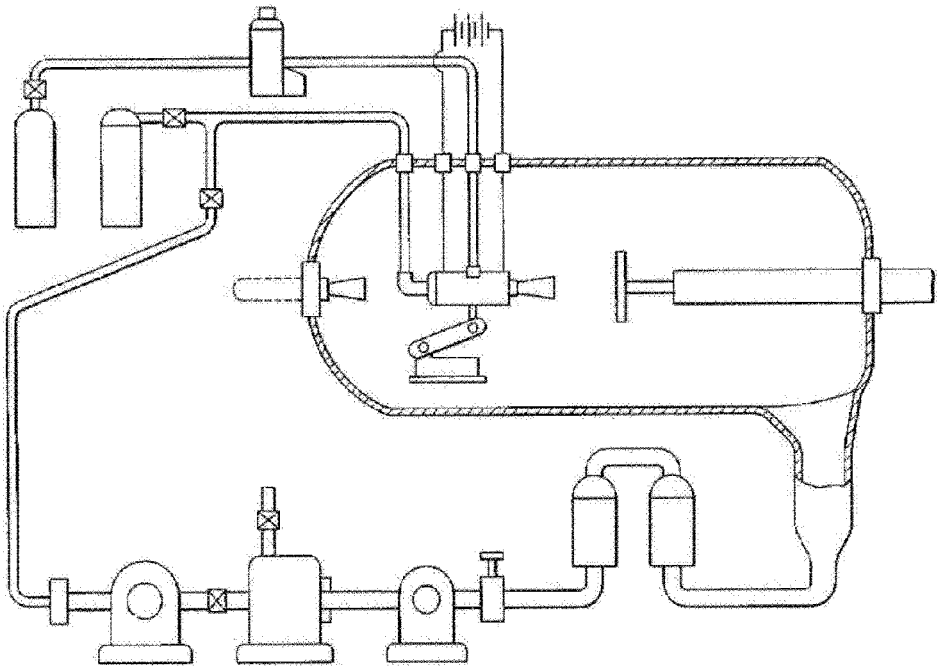
FIG. 8 is FIG. 1 of U.S. Pat. No. 6,759,085 (Prior Art 3), in which no reference numerals are used.
Figure 9:
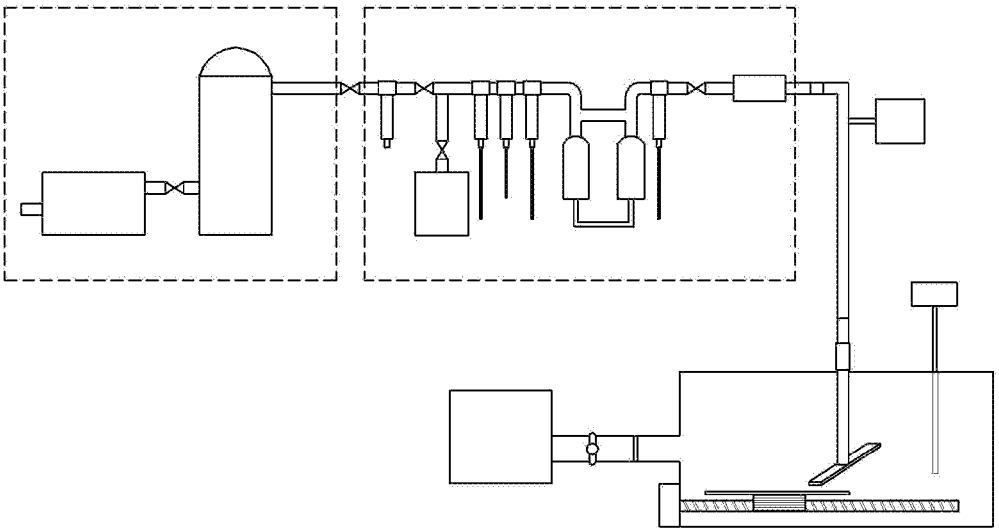
FIG. 9 is FIG. 2 of US 2011/0104369 (Prior Art 4), in which no reference numerals are used.
Figure 10:
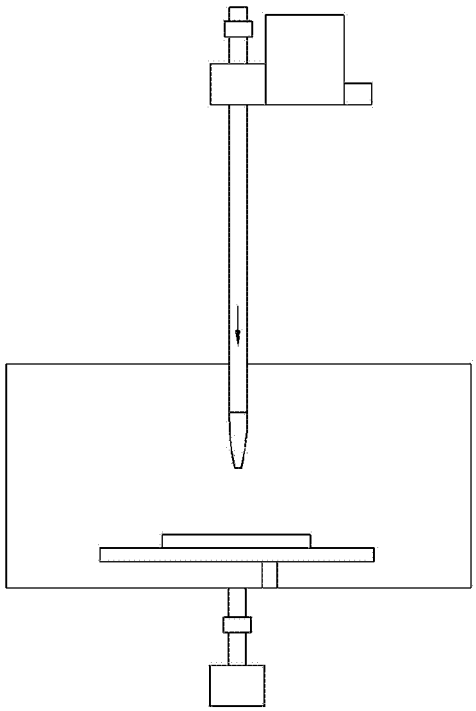
FIG. 10 is FIG. 1 of US 2013/0192519 (Prior Art 5), in which no reference numerals are used.

In addition, as shown in FIG. 5, the gas feed pipe 15 may be composed of a first section 15*a*, a second section 15*b* and a third section 15*c*, which are sequentially continuous, wherein the first section 15*a*, the second section 15*b* and the third section 15*c* may have a diameter corresponding to any one of the following diameter conditions (1) to (3):

condition (1): first section=second section=third section;

condition (2): first section≥third section≥third section; and condition (3): third section≥first section≥second section.

Furthermore, when the first section 10*a* or 15*a*, second section 10*b* or 15*b* and third section 10*c* or 15*c* of the first transport pipe 10 or the gas feed pipe 15 are sequentially connected with one another, a section 10*d* or 15*d* having a gradually increasing or decreasing cross-sectional area may be formed in all or part of a connection between a large-diameter pipe and a small-diameter pipe in a connection between the first section 10*a* or 15*a* and the second section 10*b* or 15*b* or a connection between the second section 10*b* or 15*b* and the third section 10*c* or 15*c* in order to facilitate the flow of the carrier gas 3 and the solid powder 4 between the sections.

In the case in which the spray nozzle 30 is connected to the end of the transport pipe 10, the gas feed pipe 15 may be connected not only to the first section 10*a* to the third section 10*c*, but also to the tapered section 10*d*. In this case, the diameter (D) of the gas feed pipe 15 and the diameters of the first section 10*a* to third section 10*c* of the transport pipe 10 can be determined according to the Bernoulli's theorem and the spray speed of the carrier gas.

In the case in which the spray nozzle 30 is connected to the end of the gas feed pipe 15, the transport pipe 10 may be connected not only to the first section 15*a* to the third section 15*c*, but also to the tapered section 15*d*. In this case, the diameter (D) of the transport pipe 10 and the diameters of the first section 15*a* to third section 15*c* of the gas feed pipe 15 can be determined according to the Bernoulli's theorem and the spray speed of the carrier gas.

In the present invention, the arrangement of the transport pipe 10, the gas feeding unit 20 and the solid powder feeding unit (not shown) can be modified in various ways depending on the movement paths of the sucked gas 1, the supplied gas 2 and the solid powder 4.

Hereinafter, specific embodiments of the present invention will be described with reference to the accompanying drawings.

Embodiment 1

Figure 3:
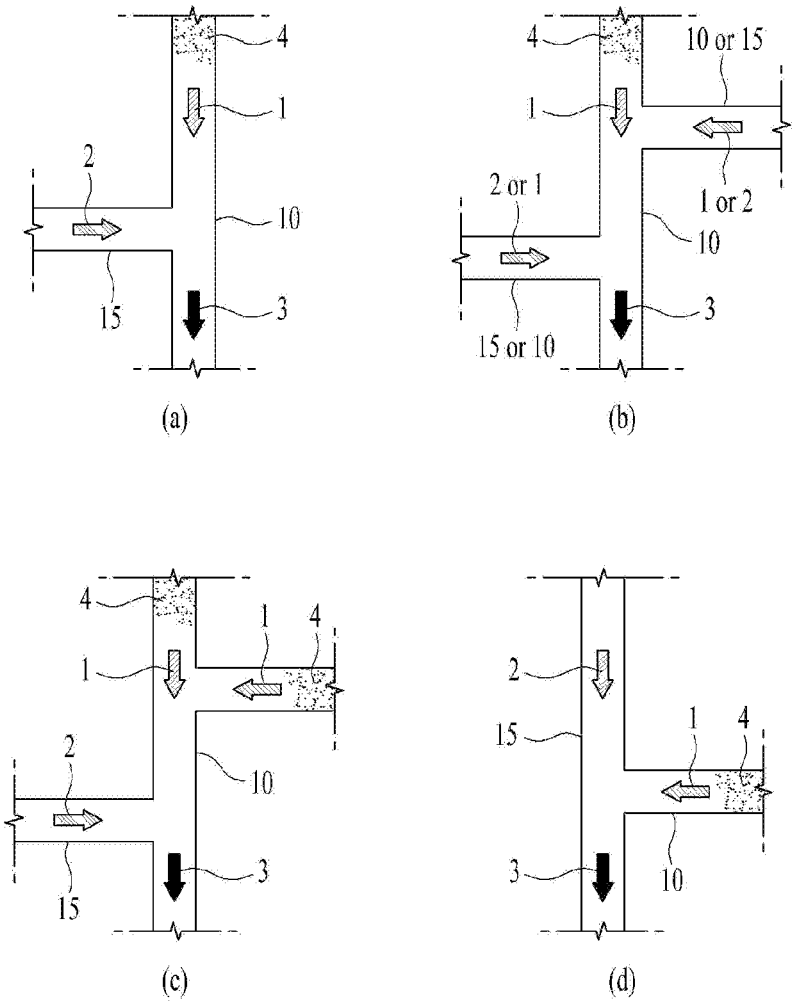
FIG. 3 is a schematic view showing an example in which sucked gas, supplied gas and solid powder are transported to a transport pipe and a gas feed pipe.

Embodiment 1 shown in FIG. 3(*a*) is configured such that the solid powder 4 together with the sucked gas 1 is introduced into the transport pipe 10 and the gas 2 is supplied through the gas supply pipe 15 communicating with one side of the transport pipe 10. In this case, the solid powder 4 is supplied to a path through which the sucked gas passes, and the solid powder 4 mixed with the sucked gas 1 is introduced into the transport pipe 10 and is mixed with the supplied gas 2, and in this state, it moves to the spray nozzle 30.

Embodiment 2

Embodiment 2 shown in FIG. 3(*b*) is configured such that the solid powder 4 together with the sucked gas 1 is introduced into the transport pipe 10, and the supplied gas 2 is supplied to one side of the transport pipe 10. In this embodiment, a channel for the sucked gas 1 is additionally provided.

Embodiment 3

Embodiment 3 shown in FIG. 3(*c*) comprises two solid powder feeding units and is configured such that the solid powder 4 from two solid powder supply units is introduced into the transport pipe 10 together with the sucked gas 1 and such that the gas 2 is supplied through the gas supply pipe 15 communicating with one side of the transport pipe 10. Thus, a mixture of two kinds of solid powders can be coated on a substrate.

Embodiment 4

Embodiment 4 shown in FIG. 3(*d*) is configured such that the sucked gas 1 and the solid powder 4 are introduced through the transport pipe 10 communicating with one side of the gas supply pipe 15 through which the supplied gas 2 passes, and a carrier gas consisting of a mixture of the supplied gas 2 and the sucked gas 1 moves toward the spray nozzle 30.

Although the present invention has been described with reference to the accompanying drawings, various modifications and alterations are possible without departing from the scope of the present invention, and the present invention can be used in various fields. Thus, the claims of the present invention encompass modifications and alterations within the true scope of the present invention.

II. Solid Powder Coating Method

The present invention provides a solid powder coating method employing a solid powder coating apparatus, the apparatus comprising: a transport pipe 10 and a gas supply pipe 15, which are configured to communicate with each other and are each composed of a first section 10*a* or 15*a*, a second section 10*b* or 15*b* and a third section 10*c* or 15*c*, which are sequentially continuous and have a diameter corresponding to any one of the following diameter conditions (1) to (3):

condition (1): first section=second section=third section;

condition (2): first section≥third section≥second section; and condition (3): third section≥first section≥second section; and a coating chamber 40 containing a spray nozzle 30 connected to the end of the transport pipe 10 or the gas supply pipe 15, the method being characterized in that a carrier gas 3 consisting of a mixture of a gas 1, sucked into the transport pipe 10 by a negative pressure generated in the coating chamber, and a gas 3 supplied from a gas supply unit 20 to the gas supply pipe 15, transports solid powder 4, introduced into the transport pipe 10 from an environment maintained at atmospheric pressure, so that the solid powder 4 is sprayed through the spray nozzle 30 and the sprayed solid powder 4 is coated on a substrate disposed in the coating chamber 40 which is in a vacuum state.

The above-described solid powder coating method is implemented by the solid powder coating apparatus according to the present invention, and the suction and supply of gas and the introduction (suction or supply) of gas, which result from control of the internal pressure of the coating chamber 40, occur at the same time or in a particular order. The solid powder coating method can be summarized as follows:

a) control of the internal pressure of the coating chamber;

b) introduction (suction) of suction gas into the transport pipe;

c) introduction (supply) of supply gas into the transport pipe;

d) introduction (suction or supply) of solid powder into transport pipe;

e) spray and coating of solid powder.

Among the above five processes, process e) is the final process. However, processes a) to d) can be combined in various orders. In the following combinations, the symbol '→' means sequential steps, and the symbol '/' means simultaneous steps.

(1) a)→b)/c)/d);
(2) a)→b)→c)→d);
(3) a)→b)/d)→c);
(4) c)→a)→b)→d);
(5) d)→a)→b)→c).

In addition to the above combinations, processes a) to d) can be combined in a more diverse manner within the scope of the present invention.

In addition, the present invention may further comprise controlling the flow rate of the supplied gas by the gas supply unit 20 and controlling the internal temperature and pressure of the transport pipe 10 and the coating chamber 40 depending on the spray speed of the carrier gas 3. Herein, the temperature of the supplied gas 2 can be controlled to a temperature between 0° C. to 600° C. depending on the spray speed of the carrier gas 3. The spray speed of the carrier gas 3 is based on the behavior of a compressive or non-compressive fluid.

The sucked gas 1 may be one or a mixture of two or more selected from among oxygen, nitrogen, argon, helium, hydrogen and air, which are under atmospheric pressure, and the supplied gas 2 may be one or a mixture of two or more selected from among oxygen, nitrogen, argon, helium, hydrogen and air.

INDUSTRIAL APPLICABILITY

As described above, according to the present invention, solid powder can be uniformly and continuously supplied to one side of the transport pipe, which is opened to atmospheric pressure, in a finely controlled manner, and thus the problem of non-uniform feeding of solid powder, which occurs in the prior art, can be solved. In addition, the spray speed of the carrier gas can be increased up to supersonic speeds as a result of using a combination of the sucked gas and the supplied gas. The present invention can be widely used in the semiconductor and electronic device fields.

The invention claimed is:

1. A solid powder coating apparatus comprising: a transport pipe provided a transport channel for solid powder; a gas supply pipe serving as a flow channel for a gas which is supplied from a gas supply unit; a spray nozzle connected to an end of the transport pipe or the gas supply pipe; a coating chamber containing the spray nozzle; a solid powder feeding unit configured to feed the solid powder, supplied from an environment which is maintained at atmospheric pressure, to the transport pipe; and a pressure control unit configured to control an internal pressure of the coating chamber, the apparatus being configured such that an atmospheric pressure gas is sucked into the transport pipe by a negative pressure formed in the coating chamber by operation of the pressure control unit, so that a sucked gas together with a supplied gas serves as a carrier gas for transporting the solid powder, each of the transport pipe and the gas supply pipe being comprised of a first section, a second section and a third section, which are sequentially continuous, wherein the first section, the second section and the third section have a diameter corresponding to any one of the following diameter conditions (1) to (3):

condition (1): first section=second section=third section;

condition (2): first section≥third section≥second section; and condition (3): third section≥first section≥second section.

2. The solid powder coating apparatus of claim 1, wherein one side of the transport pipe is opened to atmospheric pressure, so that atmospheric pressure gas is sucked into the open side of the transport pipe by the negative pressure in the coating chamber by operation of the pressure control unit.

3. The solid powder coating apparatus of claim 1, comprising one or more solid powder feeding units configured to feed the solid powder to the transport pipe.

4. The solid powder coating apparatus of claim 3, wherein the solid powder feeding units are configured such that the solid powder stored under atmospheric pressure is introduced into the transport pipe together with the sucked gas.

5. The solid powder coating apparatus of claim 1, further comprising a supplied gas flow rate control unit configured to control a temperature of the supplied gas.

6. The solid powder coating apparatus of claim 1, further comprising a supplied gas temperature control unit configured to control a temperature of the supplied gas.

7. The solid powder coating apparatus of claim 1, further comprising a pressure-temperature measurement unit disposed in the transport pipe or the gas supply pipe and in the coating chamber so as to measure pressure and temperature in real time.

8. The solid powder coating apparatus of claim 1, further comprising a position control unit coupled to the spray nozzle so as to control a position of the spray nozzle relative to a substrate disposed in the coating chamber.

9. The solid powder coating apparatus of claim 8, wherein the position control unit is consists of an arm which is coupled to the spray nozzle so as to be movable linearly, curvilinearly or rotatively.

10. The solid powder coating apparatus of claim 1, further comprising a substrate stand disposed in the coating chamber so as to a position of the substrate relative to the spray nozzle.

11. The solid powder coating apparatus of claim 10, wherein the substrate stand is coupled to an arm which is movable linearly, curvilinearly or rotatively.

12. The solid powder coating apparatus of claim 1, further comprising a coating chamber temperature control unit configured to control an internal temperature of the coating chamber.

13. The solid powder coating apparatus of claim 1, further comprising a collector configured to collect the solid powder remaining in the coating chamber after spray into the coating chamber.

14. The solid powder coating apparatus of claim 1, wherein a section **10*d*** having a gradually increasing or decreasing cross-sectional area is formed in all or part of a connection between large-diameter pipe and a small-diameter pipe in a connection between the first section and the second section of the transport pipe or a connection between the second section and the third section of the transport pipe.

15. The solid powder coating apparatus of claim 1, wherein a fourth section having a gradually increasing or decreasing cross-sectional area is formed in all or part of a connection between large-diameter pipe and a small-diameter pipe in a connection between the first section and the second section of the gas supply pipe or a connection between the second section and the third section of the gas supply pipe.

16. A solid powder coating method employing a solid powder coating apparatus, the apparatus comprising:

a transport pipe and a gas supply pipe, which are configured to communicate with each other and are each comprised of a first section, a second section and a third section, which are sequentially continuous and have a diameter corresponding to any one of the following diameter conditions (1) to (3):

condition (1): first section=second section=third section;

condition (2): first section≥third section≥second section; and condition (3): third section≥first section≥second section;

a coating chamber containing a spray nozzle connected to an end of the transport pipe or the gas supply pipe, the method being characterized in that a carrier gas comprised of a mixture of a gas, sucked into the transport pipe by a negative pressure generated in the coating chamber a gas supplied from a gas supply unit to the gas supply unit, transports solid powder, introduced into the transport pipe from an environment which is maintained at atmospheric pressure, so that the solid powder is sprayed through the spray nozzle and the spray solid powder is coating on a substrate disposed in the coating chamber which is in a vacuum state.

17. A solid powder coating method of claim 16, further comprising controlling a flow rate of the supplied gas provide from the gas supply unit to thereby control an internal pressure of the transport pipe or the gas supply pipe depending on a spray speed of the carrier gas.

18. A solid powder coating method of claim 17, wherein a temperature of the supplied gas is between 0° C. and 600° C.

19. A solid powder coating method of claim 16, further comprising controlling a temperature of the carrier gas in the transport pipe or the gas supply pipe depending on a spray speed of the carrier gas.

20. The solid powder coating method of claim 16, wherein the sucked gas is one or a mixture of two or more selected from among oxygen, nitrogen, argon, helium, hydrogen and air, which are under atmospheric pressure.

21. The solid powder coating method of claim 16, wherein the supplied gas is one or a mixture of two or more selected from among oxygen, nitrogen, argon, helium, hydrogen and air.

* * * * *